US005954212A

United States Patent [19]

Beatty et al.

[11] Patent Number: 5,954,212

[45] Date of Patent: Sep. 21, 1999

[54] LIGHTWEIGHT KNUCKLE FOR A RAILROAD CAR COUPLER

[75] Inventors: Scott A. Beatty, Chicago; Douglas W. Smith, Romeoville, both of Ill.

[73] Assignee: National Castings Incorporated, Downers Grove, Ill.

[21] Appl. No.: 09/009,339

[22] Filed: Jan. 20, 1998

[51] Int. Cl.[6] ..... B61G 3/00

[52] U.S. Cl. ..... 213/155; 213/109

[58] Field of Search ..... 213/104, 105, 213/109, 113, 114, 151, 152, 155

[56] References Cited

U.S. PATENT DOCUMENTS

| | | | |
|---|---|---|---|
| 2,245,043 | 6/1941 | Metzger | 213/151 |
| 3,722,708 | 3/1973 | Ion et al. | 213/151 |
| 3,779,397 | 12/1973 | De Penti | 213/155 |
| 4,206,849 | 6/1980 | Kaim | 213/151 |
| 4,640,422 | 2/1987 | Elliott | 213/155 |
| 5,582,307 | 12/1996 | Hawthorne et al. | 213/155 |

*Primary Examiner*—Mark T. Le

[57] ABSTRACT

An improved lightweight knuckle is described for use in an AAR Standard E or F type railroad car coupler. The outer contouring and inner voids of the improved lightweight knuckle are radically changed without compromising the integrity or operability of the knuckle during conventional coupling and uncoupling operations with, and from, an existing AAR Standard knuckle. The nose of the improved lightweight knuckle is provided with a pair of parallel, coplanar flat surfaces between which is a projection which extend outwardly from the flat surfaces and terminates at an outer curved surface which has the same curvature as the corresponding curvature of an existing AAR Standard knuckle. Also, twin sets of reinforcement ribs are provided within the improved lightweight knuckle to strengthen the knuckle and make it more durable.

20 Claims, 4 Drawing Sheets

LIGHTWEIGHT KNUCKLE FOR A RAILROAD CAR COUPLER

BACKGROUND OF THE INVENTION

The invention relates to AAR Standard F and E type railroad car couplers, especially to the knuckles used in these couplers. More particularly, the invention relates to improvements in the lightweight knuckle which is described and claimed in United States patent application, Ser. No. 08/636,033 filed Apr. 22, 1996, which is made a part of this application. Such lightweight knuckles can be used to replace existing, heavier AAR Standard knuckles.

For example, lightweight knuckles can be used in an emergency to replace AAR Standard knuckles which become damaged during operation. AAR Standard knuckles weigh approximately 78 to 88 pounds and are presently carried in the locomotive section of a train to replace any knuckles which become damaged and inoperable during operation of the train. In some cases, it may be necessary for a single operator to carry such a knuckle the length of 25, 50 or even 100 railroad cars to reach a defective knuckle which needs replacement. Then the operator must manipulate the replacement knuckle into position on the coupler, after the damaged knuckle is removed, which is no simple task. In fact, it is a necessary and important job, but a back breaking one to say the least. The invention is designed to alleviate this problem by the provision of a substantially lighter weight knuckle which weighs only about 48–54 pounds, or substantially less than an AAR Standard knuckle. Most importantly, the integrity of an AAR Standard knuckle has not been compromised. That is, this new lightweight knuckle will function or operate the same as an AAR Standard knuckle in relation to the other components of the coupler and those of an opposing coupler during, for example, the coupling and uncoupling operations. The goal of this invention is to design a lightweight knuckle which will eventually replace the much heavier AAR Standard knuckles in use today.

Briefly stated, careful stress analysis tests have been performed on AAR Standard knuckles to determine what areas of these knuckles can be reduced, in size or weight, or even eliminated without adversely effecting the function or operability of the knuckle. The result is a lightweight knuckle which has a unique contour or shape with different coring, both of which features are designed to eliminate extraneous material inside and outside the knuckle to produce, from a practical standpoint, the lightest possible knuckle which has sufficient strength to withstand the draft or pull loads and the push or buff loads, both of which loads are imposed upon existing AAR Standard knuckles during operation.

This lightweight knuckle utilizes industry standard grade E steel alloy material for excellent strength, toughness, and wear properties, and is compatible with all conventional knuckle type railroad freight car couplers. Moreover, the other conventional components of this lightweight knuckle, such as locks, throwers, and AAR Standard mating knuckles, do not need modification, but are fully compatible with this lightweight knuckle. Also, all industry standards as to form, fit, and function of a standard knuckle, such as 10A contour angling, coupling and gathering angles, lock drop and support, and anti-creep functionality, are maintained and not compromised.

DESCRIPTION OF THE DRAWING

The following description of the invention will be better understood by having reference to the accompanying drawing, wherein.

DETAILED DESCRIPTION OF THE DRAWING

Figure 1:
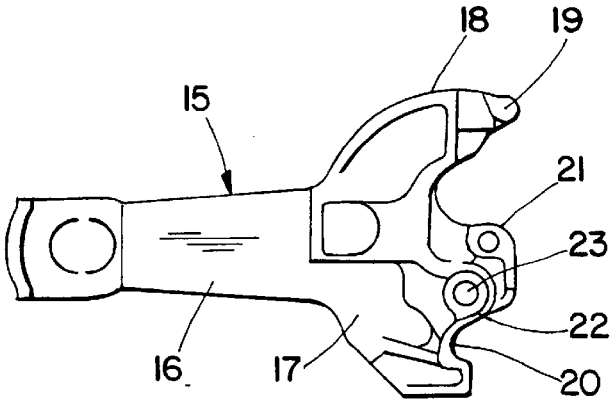
Fig. 1 (PRIOR ART)
FIG. 1 is a plan view of an AAR Standard type F interlocking railroad car coupler.

With particular reference to FIG. 1 of the drawing, there is shown an AAR Standard type F interlocking coupler 15 which comprises an elongated shank 16 which terminates at a coupler head 17 which includes a guard arm 18 and nose 19 at one side and a pocket 20 at the opposing side for receiving the guard arm nose of an opposing F coupler during the coupling of two F couplers. An AAR Standard knuckle 21 is mounted on a pivot lug 22 of the coupler head 17, adjacent the pocket 20, by means of a vertical pivot pin 23 for rotation in a horizontal plane, when the F coupler 15 is horizontally disposed.

Figure 2:
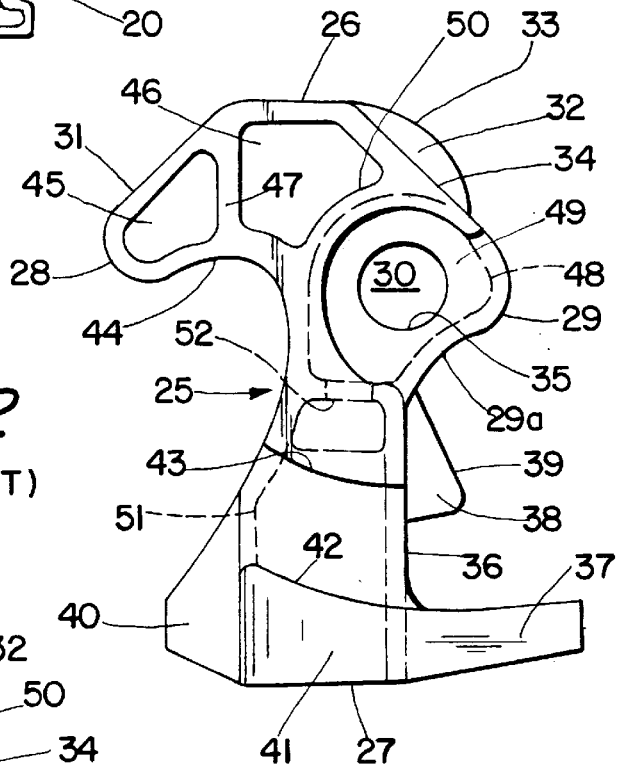
Fig. 2 (PRIOR ART)
FIG. 2 is a plan view of the lightweight F knuckle of the aforementioned patent application.

With general reference to the drawing for like parts, and specific reference to FIG. 2, there is shown the lightweight knuckle 25 of the aforementioned patent application. This lightweight knuckle 25 and the following described lightweight E and F knuckles of the invention, are, for descriptive and claiming purposes, assumed to be in a horizontal plane where each lightweight knuckle has: a flat front face 26 facing in a northerly direction, a tail 27 facing in a southerly direction, a rounded nose 28 facing in a westerly direction, and a curved side 29, adjacent and outwardly of the pin hole 30, facing in an easterly direction.

The nose 28 has a flat surface 31 which faces in a northwesterly direction. A heel 32, having an outer curved surface 33 which is similar to that of an AAR Standard knuckle, extends outwardly from between a pair of coplanar, flat surfaces 34 which face in a northeasterly direction and extend from the front face 26 to the easterly facing curved side 29.

The easterly facing side 29, approximately due east of the southern most part 35 of the pin hole 30, curves inwardly towards a center plane, which extends in a north/south direction near the center of the pin hole 30, where it becomes a flat surface 36 which extends in a southerly direction and terminates at a unique tail stop 37 which extends in an easterly direction from the tail 27 and is best described in the aforementioned patent application. A triangular shaped projection 38 extends outwardly from the easterly facing flat surface 36 in spaced relation from the tail stop 37, and has a flat, rectangularly shaped thrower pad 39 similar to that of an AAR Standard knuckle.

The lightweight knuckle 25 is provided with a lock shelf 40, a lock ledge 41, a pair of pulling lugs 42, a pair of buffing shoulders 43, and a pulling face 44 on the nose 28, all of which are similar to the corresponding components of an AAR Standard knuckle.

The lightweight knuckle 25 has, I} a first void 45 which extends transversely of the knuckle 25 in the area of the nose 28, II} a second void 46 which extends transversely of the knuckle 25 between the front face 26 and pulling face 44 in farther spaced relation from the nose 28 than the first void 45, the second void 46 being separated from the first to void 45 by a first, generally flat web 47 which extends in a northerly direction from the pulling face 44 to the juncture of the front face 26 with the flat surface 31 on the nose 28, and III} a third void 48 which extends transversely of the knuckle 25 between a pair of vertically spaced plates 49 which contain vertically aligned pin holes 30, the third void 48 being farther spaced from the nose 28 than the second void 46 and separated from the second void 46 by a curved, second web 50. A fourth void 51 is provided in the knuckle 25 and extends from the tail 27 longitudinally into the knuckle 25 in a northerly direction towards the third void 48, the fourth void 51 being separated from the third void 48 by a third web 52. The first web 47 may be expanded, as described in the aforementioned patent application, to strengthen the nose 28 of the knuckle 25 without substantially increasing the weight of the lightweight knuckle 25. Further, the lightweight knuckle 25 can be provided with a flag hole, as described in said patent application, if desired.

Thus, it can be appreciate by those skilled in the art that the above described lightweight knuckle 25 has all the essential components of an AAR Standard knuckle, so that it will operate or function in all respects like an AAR Standard knuckle, that is, it can rotate into and out of coupling relation with an opposing AAR Standard knuckle during the coupling and uncoupling operations.

The Invention

With reference to FIGS. 3–7, there is shown a lightweight E knuckle 55 for use in an AAR Standard E railroad car coupler. The lightweight E knuckle 55 has all of the aforementioned components. In addition, the nose 28 has a projection or lug 56 which extends outwardly from the northwesterly facing, flat surface 31 and divides such surface 31 into two equal, coplanar flat surfaces 57. The lug 56 is sufficiently wide and has an outer surface 58 which has the same curvature as the corresponding curvature of an AAR Standard knuckle of an AAR Standard E coupler, to enhance coupling of the lightweight E knuckle 55. The lug 56 also strengthens the nose 28.

The tail stop 37 and the triangularly shaped projection 38 and thrower pad 39, are provided with correspondingly shaped recesses or cavities 59 and 60, respectively. In this way, the weight of these two particular components are reduced without adversely effecting the strength or operability of these two parts.

Figure 3:
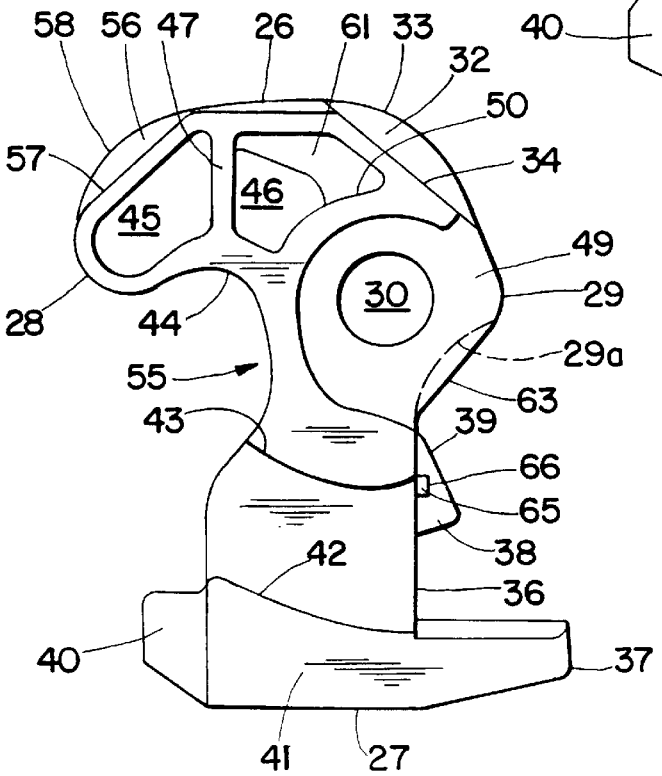
FIG. 3 is a plan view of a new lightweight E knuckle which is made in accordance with the invention for use in an AAR Standard E railroad car coupler.
Figure 4:
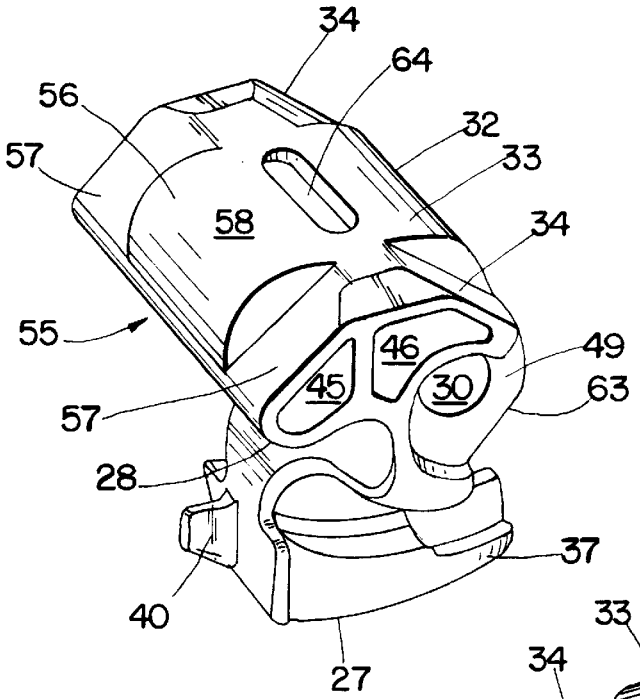
FIG. 4 is a perspective view of the new lightweight E knuckle.
Figure 5:
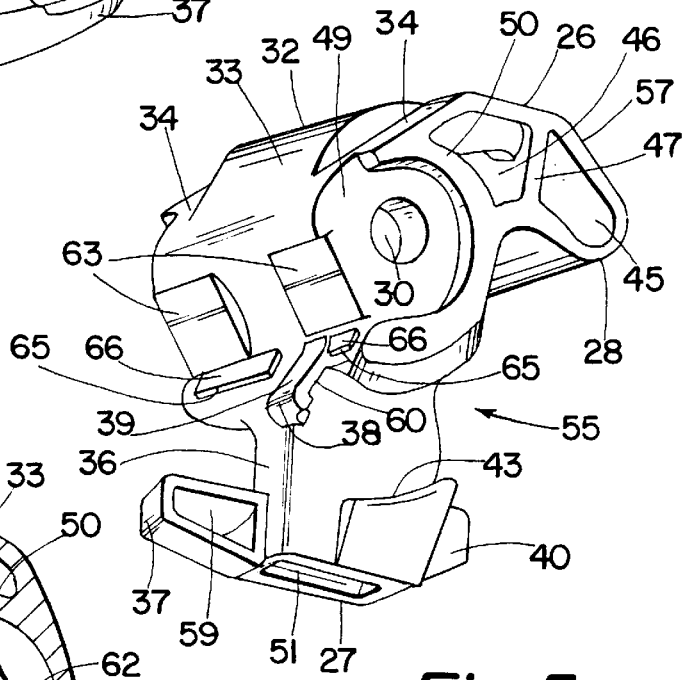
FIG. 5 is another perspective view of the new lightweight E knuckle.
Figure 6:
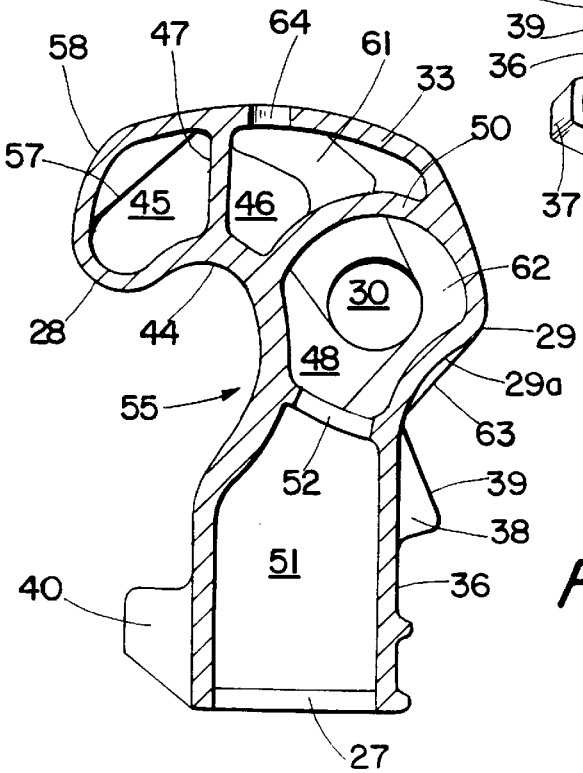
FIG. 6 is a longitudinal cross section of the new lightweight E knuckle.
Figure 7:
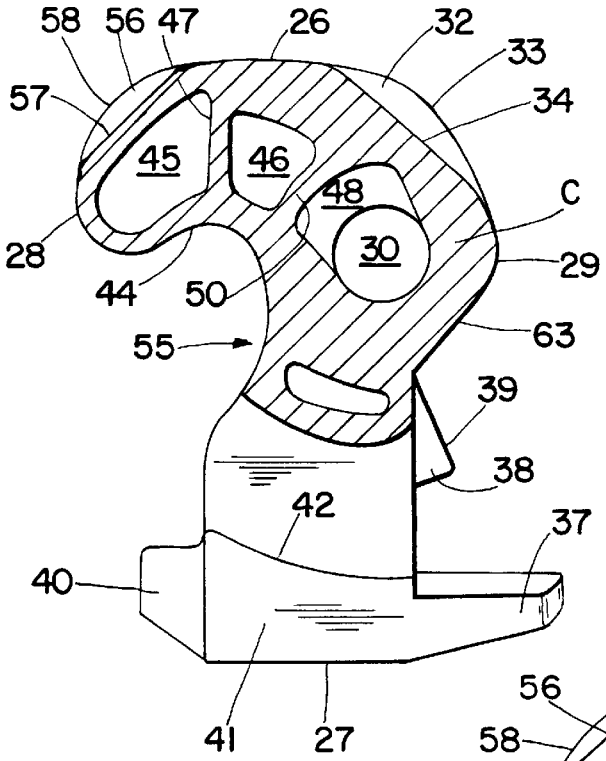
FIG. 7 is a longitudinal section taken through the nose and reinforcement ribs of the new lightweight E knuckle.

A first set of similar, generally flat and parallel reinforcement ribs 61 are provided in transversely spaced relation within the second void 46, and extend from the front face 26 and northeasterly facing lug 56 and adjacent pair of flat surfaces 57. A second set of similar, U-shaped, generally flat and parallel reinforcement ribs 62, as best seen in FIG. 6, are transversely spaced within the third void 48 and partially surround the pin holes 30 and pivot pin, when a pivot pin is used to mount the lightweight E knuckle 55 on an AAR Standard E coupler. It can be appreciated from a study of FIGS. 6 and 7 that the first set of reinforcement ribs 61 are generally in coplanar relation with the second set of reinforcement ribs 62. Moreover, the second vertical web 50 forms with the horizontal reinforcement 61 and 62, a rigid and integral, internal reinforcement cage or core C which greatly enhances the strength and durability of the lightweight E knuckle 55. The first and second sets of reinforcement ribs 61 and 62 are formed during the casting process, when molten metal is poured into the mold from the mold surfaces which form a pair of similar and parallel flat surfaces 63 (FIGS. 5–7) on the southeasterly facing, normally curved surface 29*a* of the easterly facing curved side 29 of the lightweight E knuckle 55. The two sets of reinforcement ribs 61 and 62 add considerable strength to the lightweight E knuckle without adding a substantial amount of weight. The reinforcement ribs 61 and 62 are beneficial in the solidification process and can have any suitable shape, so long as it is compatible with the casting process and does not interfere with the operability of the lightweight E knuckle 55. It is believed that the shapes of the reinforcement ribs 61 and 62, shown in FIGS. 3 and 6, provide the best compromise between the greatest strength and minimal weight added to the lightweight E knuckle 55.

An oblong shaped opening 64 is transversely disposed in the flat, front face 26 in general alignment with the lug 58 and heel 32 to, for example, compensate for the added weight of the reinforcement ribs 61 and 62, without critically affecting the strength of the lightweight E knuckle 55.

A pair of similar stop pads 65 are disposed in generally vertical alignment on either side of the thrower pad 39 of the lightweight E knuckle 55. The stop pads 65 are unequally spaced from the thrower pad 39 and have slightly sloping flat surfaces 66 which are designed to matingly engage drafted walls in the AAR Standard E coupler, when the lightweight E knuckle 55 is buff loaded, i.e. loaded in compression. The stop pads 65 help reduce excess rotation of the knuckle, and help bear some of the buff loads. The stop pads 65 are also useful when the side walls of the lightweight E knuckle 55 are not drafted.

With particular reference to FIGS. 8–13, there is shown a lightweight F knuckle 70 which is designed for use in an AAR Standard F railroad car coupler. The lightweight F knuckle 70 has essentially the same improvements which are defined above in relation to the lightweight E knuckle 55. However, as best seen from a comparison of FIGS. 4 and 9, the projection 56 of the lightweight F knuckle 70 has a much narrower width, measured laterally of the nose 28, than the correspondingly measured projection 56 of the lightweight E knuckle 55. In each of the lightweight E and F knuckles 55 and 70, respectively, the widths of the projections 56 and heels 32 are substantially the same. Accordingly, the correspondingly measured widths of the northeasterly facing, flat surfaces 34 of the lightweight F knuckle 70 are much wider than those of the lightweight E knuckle 55. This is important in the formation of the two sets of reinforcement ribs 71 and 72 which are disposed in the second and third voids 46 and 48, respectively, of the lightweight F knuckle 70, and which are different from the corresponding two sets of reinforcement ribs 61 and 62 of the lightweight E knuckle 55.

Figure 8:
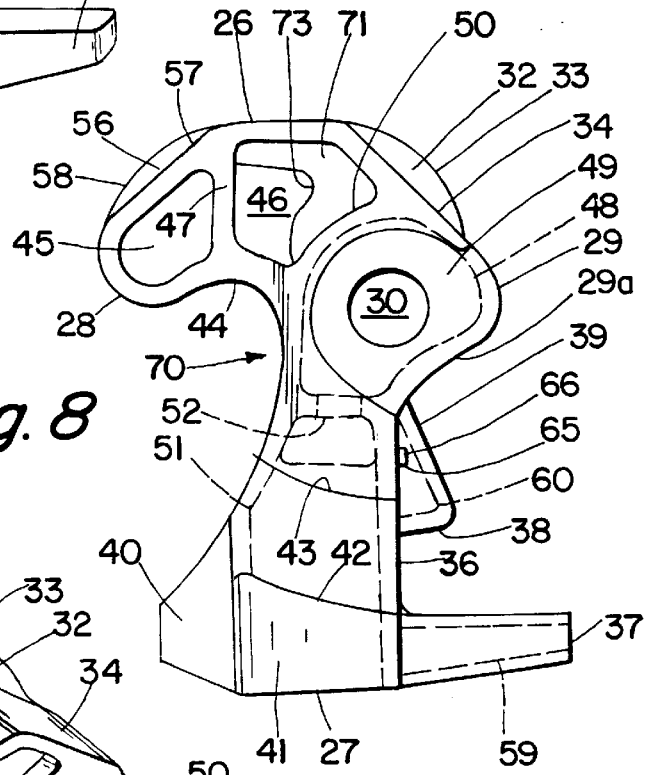
FIG. 8 is a plan view of a new lightweight F knuckle which is made in accordance with the invention for use in an AAR Standard F railroad car coupler.
Figure 9:
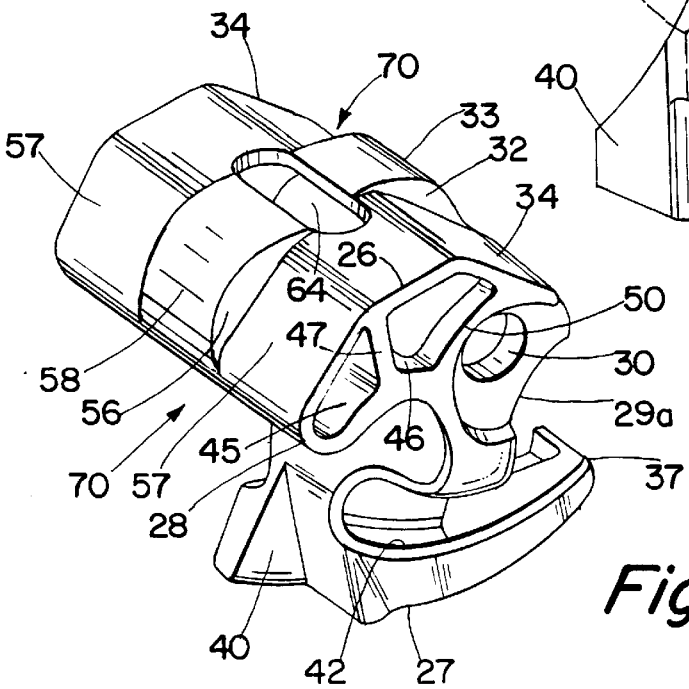
FIG. 9 is a perspective view of the new lightweight F knuckle.
Figure 10:
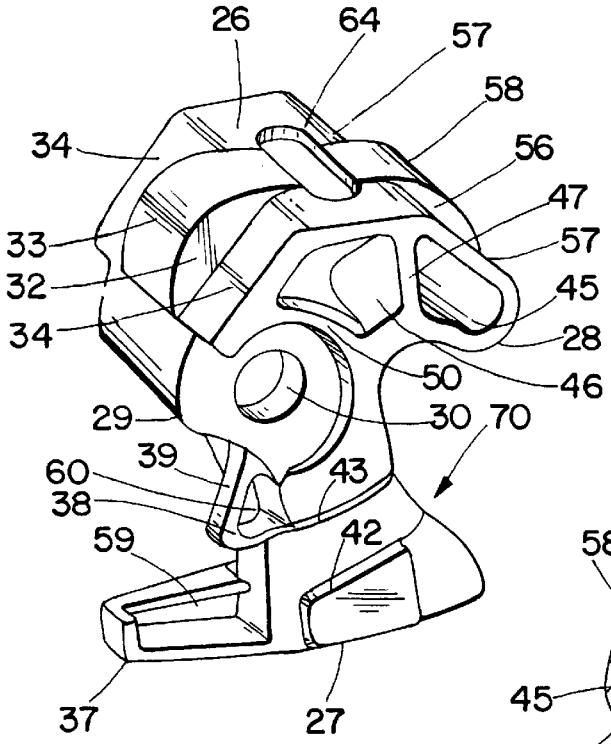
FIG. 10 is another perspective view of the new lightweight F knuckle.

For example, the first set of reinforcement ribs 71 within the second void 46 of the lightweight F knuckle 70, have shapes which are somewhat similar to the shapes of the first set of reinforcement ribs 61 of the lightweight E knuckle 55, as can be seen from a comparison of FIGS. 3 and 8, except that the first set of reinforcement ribs 71 of the lightweight F knuckle 70 have a more pronounced V-shaped valley 73, when viewed from above, or in an easterly direction.

Figure 11:
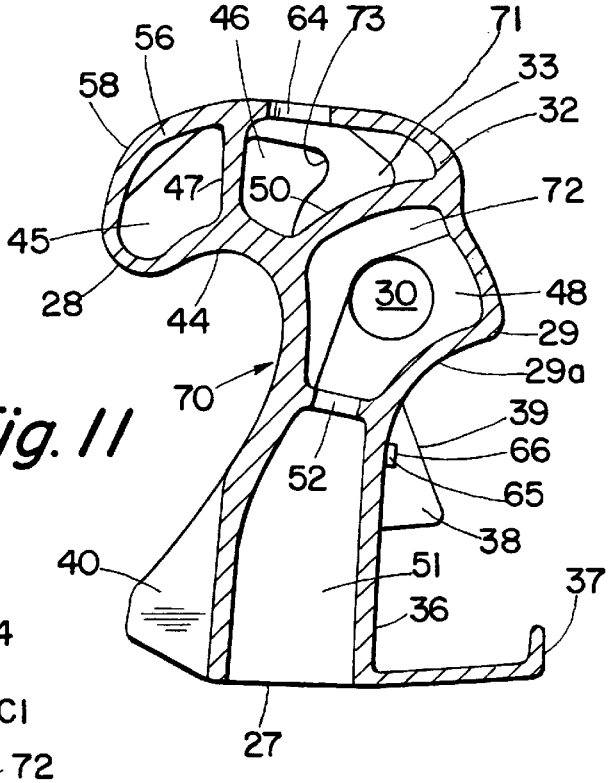
FIG. 11 is a longitudinal cross section of the new lightweight F knuckle.
Figure 12:
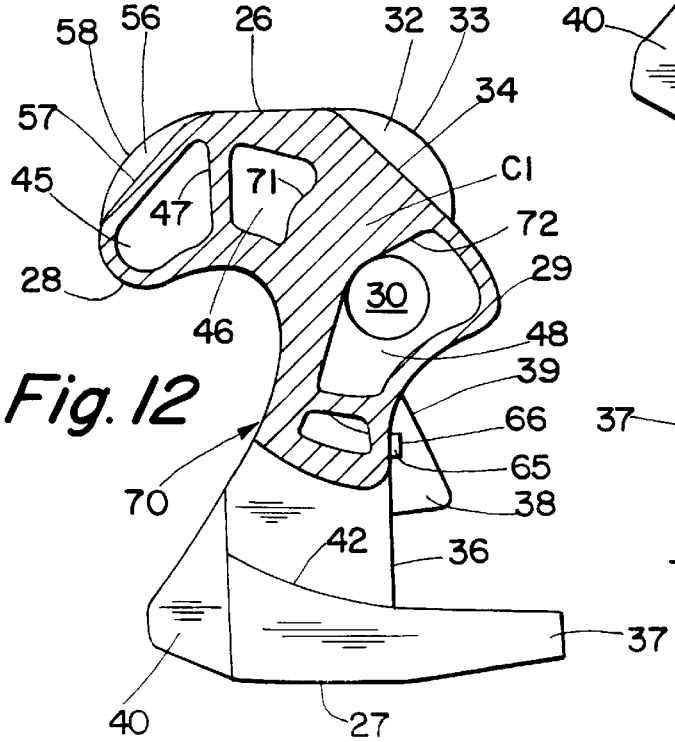
FIG. 12 is a longitudinal section taken through the nose and reinforcement ribs of the new lightweight F knuckle.

It can be seen from a comparison of FIGS. 6 and 11, that the second set of reinforcement ribs 72 of the lightweight F knuckle 70 have more of a V-shape, when viewed from above, or in a northeasterly direction, and are oppositely disposed to the corresponding, U-shaped reinforcement ribs 62 of the lightweight E knuckle 55. This is because the reinforcement ribs 71 and 72 of the lightweight F knuckle 70 are formed when molten metal is poured into the mold from the mold surfaces which form the pair of northeasterly facing, twin flat surfaces 34 which are on opposite sides of the heel 32. The second set of reinforcement ribs 72 of the lightweight F knuckle 70 also partially surround the pin holes 30 and a pivot pin inserted therein, but would engage the pivot pin at a point opposite that which the corresponding, second set of reinforcement ribs 62 of the lightweight E knuckle 55, would engage. The first and second sets of reinforcement ribs 71 and 72 of the lightweight F knuckle 70 are also in coplanar relation and form with the second web 50, a rigid and integral, inner reinforcement cage or core C1 which greatly enhances the strength and durability of the lightweight F knuckle 70. The inner reinforcement core C1 has a configuration which is different from that of the corresponding reinforcement core C of the lightweight E knuckle 55, but this is because of the location at which molten metal is poured into the molds of the two lightweight knuckles 55 and 70. The first and second sets of reinforcement ribs 71 and 72 of the lightweight F knuckle 70 are also beneficial in the solidification process.

Figure 13:
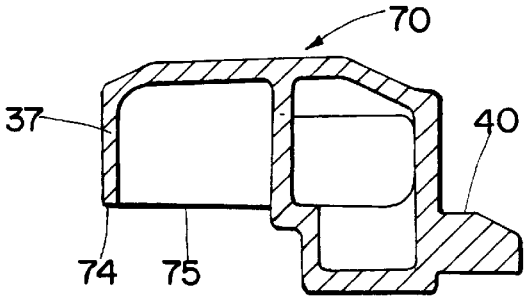
FIG. 13 is a section of the tail of the new lightweight F knuckle.

With particular reference to FIG. 13, the lower side wall 76 and lower rear wall 77 of the tail stop 37 of the lightweight F knuckle 70, are at the same height in generally coplanar relation with the lock shelf 40 on the other side of the lightweight F knuckle 70, to keep the anti-creep toggle, when installed in an AAR Standard F coupler, from moving under the tail stop 37, when the lightweight F knuckle 70 is open. If this happens, the lightweight F knuckle 70 will not completely close and lock. This feature is only provided on a lightweight F knuckle for an AAR Standard F coupler, since there is no anti-creep toggle on an AAR Standard E coupler in which a lightweight E knuckle 55 is used.

Thus, there has been described improved lightweight knuckles for E and F type railroad car couplers. These lightweight knuckles have been reinforced in certain areas to highly improve their strength, durability and operability while, at the same time, removing material in other areas which lighten the knuckles without adversely effecting the strength or operability of the knuckles.

What is claimed is:

1. A lightweight knuckle for a railroad car, comprising:

a) a front face;

b) a tail in opposed spaced relation from the front face;

c) a heel extending from the front face at an end of the front face;

d) a pin hole in the knuckle adjacent the heel between the front face and tail; and e) a nose extending from the front face at an end of the front face opposite the heel, the nose having a pair of parallel, coplanar flat surfaces and a projection which extends outwardly from the nose from between the coplanar surfaces, the projection having a surface which curves outwardly from the flat surfaces.

2. The lightweight knuckle of claim 1, comprising:

f) a first void extending transversely of the nose;

g) a second void extending transversely of the knuckle and being adjacent the first void and front face;

h) a third void extending transversely of the knuckle adjacent the second void and in an area of the pin hole; and i) at least one pair of coplanar reinforcement ribs, a first rib of the at least one pair of ribs being in the second void and extending transversely of the second void in a direction toward the nose, and a second rib of the at least one pair of ribs being in the third void and extending transversely of the third void, the second rib at least partially surrounding the pin hole and a pivot pin, when such pin is in the pin hole.

3. The lightweight knuckle of claim 2, comprising a second pair of coplanar and parallel reinforcement ribs which are identical to the at least one pair of reinforcement ribs and which are similarly oriented to corresponding ribs of the at least one pair of ribs.

4. The lightweight knuckle of claim 3, wherein the ribs in the third void are each generally U-shaped and extend around the pin hole in a direction toward the front face and nose.

5. The lightweight knuckle of claim 3, wherein the ribs in the third void are each generally V-shaped and extend around the pin hole in a direction toward the front face and nose.

6. The lightweight knuckle of claim 3, wherein the ribs in the second void diminish, in size and bulk, in a direction toward the nose.

7. The lightweight knuckle of claim 3, wherein the front face has an oblong opening therein.

8. The lightweight knuckle of claim 3, which includes: a tail stop which has a correspondingly shaped cavity therein, and a thrower pad which is part of a triangular projection which has a correspondingly shaped cavity therein.

9. The lightweight knuckle of claim 8, which includes a flat, buff stop pad on either side of the thrower pad in unequal spaced relation from the thrower pad, the buff stop pads designed to matingly engage adjacent walls of an AAR Standard coupler.

10. The lightweight knuckle of claim 3, which includes: a lock shelf, and a tail stop which has rear and side walls which are generally coplanar with the lock shelf.

11. The knuckle of claim 3, which includes:

j) a side between the heel and tail of the knuckle, the side curving around the pin hole and then becoming generally flat as it extends in a direction toward the tail.

12. The lightweight knuckle of claim 11, which includes:

k) a triangular-shaped projection which extends outwardly from the generally flat side of the knuckle, the triangular-shaped projection having a flat, rectangular pad which is angularly disposed to the generally flat side of the knuckle.

13. The lightweight knuckle of claim 12, wherein the heel is sufficiently wide and curved to engage and deflect a guard arm nose of an AAR Standard railroad car coupler, the heel projecting from between a pair of coplanar flat surfaces which face outwardly of the knuckle.

14. The lightweight knuckle of claim 13, wherein the heel and front nose projection have generally the same width, measured between the flat surfaces on either side of the heel and front nose projection.

15. A lightweight knuckle for a railroad car coupler, comprising:

a) a front face;

b) a tail in opposed spaced relation from the front face;

c) a heel extending from the front face at one end of the heel;

d) a pin hole in the lightweight knuckle adjacent the heel and between the front face and the tail;

e) a nose extending from the front face at an end of the front face opposite the heel, the nose having a projection which extends outwardly from between a pair of coplanar flat surfaces;

f) three voids extending transversely of the knuckle, including: a first void in the nose, a second void adjacent the first void and the front face, and a third void adjacent the second void and in an area of the pin hole; and g) two sets of reinforcement ribs disposed within at least two of the voids, including: a first set of ribs having a pair of parallel ribs which are transversely spaced in at least a portion of the second void, and a second set of ribs having a pair of parallel ribs which are transversely spaced in at least a portion of the third void, the ribs of the first set of ribs being in generally coplanar relation with the ribs of the second set of ribs, the first and second sets of ribs being joined by a web between them, the ribs in at least a portion of the third void designed to at least partially surround a pivot pin placed in the pin hole.

16. The lightweight knuckle of claim 15, wherein the ribs in at least a portion of the third void are generally U-shaped.

17. The lightweight knuckle of claim 15, wherein the front face is flat and has an oblong opening with curved corners therein.

18. The lightweight knuckle of claim 15, which includes: a tail stop with a correspondingly shaped cavity therein, and a triangular projection having a thrower pad and a correspondingly shaped cavity therein.

19. The lightweight knuckle of claim 18, which includes a flat, buff stop pad spaced on either side of the thrower pad, the buff stop pads designed to matingly engage adjacent walls of an AAR Standard coupler.

20. The lightweight knuckle of claim 19, wherein the tail has rear and side wall which are generally coplanar with a lock shelf of the knuckle.

* * * * *